US009321071B2

(12) United States Patent
Jordan et al.

(10) Patent No.: US 9,321,071 B2
(45) Date of Patent: Apr. 26, 2016

(54) HIGH FREQUENCY UNIFORM DROPLET MAKER AND METHOD

(71) Applicants: AMASTAN TECHNOLOGIES LLC, North Andover, MA (US); University of Connecticut, Farmington, CT (US)

(72) Inventors: Eric Jordan, Storrs, CT (US); Makhlouf Redjdal, Storrs-Mansfield, CT (US); Kamal Hadidi, Somerville, MA (US)

(73) Assignees: AMASTAN TECHNOLOGIES LLC, North Andover, MA (US); UNIVERSITY OF CONNECTICUT, Farmington, CT (US)

( * ) Notice: Subject to any disclaimer, the term of this patent is extended or adjusted under 35 U.S.C. 154(b) by 402 days.

(21) Appl. No.: 13/630,318

(22) Filed: Sep. 28, 2012

(65) Prior Publication Data

US 2014/0091155 A1 Apr. 3, 2014

(51) Int. Cl.
*B05B 17/06* (2006.01)

(52) U.S. Cl.
CPC ..... *B05B 17/0669* (2013.01); *B05B 17/0607* (2013.01)

(58) Field of Classification Search
CPC ..... B05B 17/0669; B05B 17/0607
USPC ..... 239/102.1, 102.2, 690, 699, 225.1, 226, 239/230, 4, 260; 347/5, 9, 10, 11, 12, 20, 347/44, 47, 48, 57, 58, 59, 73, 74, 75
See application file for complete search history.

(56) References Cited

U.S. PATENT DOCUMENTS

| | | | | |
|---|---|---|---|---|
| 3,848,118 | A * | 11/1974 | Rittberg | 239/101 |
| 4,727,378 | A * | 2/1988 | Le | B41J 2/19 347/21 |
| 4,743,924 | A * | 5/1988 | Scardovi | 347/10 |
| 4,879,568 | A | 11/1989 | Bartky et al. | |
| 5,171,360 | A | 12/1992 | Orme et al. | |
| 5,400,064 | A | 3/1995 | Pies et al. | |
| 7,281,778 | B2 | 10/2007 | Hasenbein et al. | |
| 7,407,273 | B2 * | 8/2008 | Gau et al. | 347/68 |
| 2005/0024424 | A1 * | 2/2005 | Murayama | 347/30 |
| 2005/0190220 | A1 | 9/2005 | Lim et al. | |
| 2009/0153627 | A1 * | 6/2009 | Barbet | 347/76 |
| 2014/0151582 | A1 * | 6/2014 | Rollinger et al. | 250/504 R |

OTHER PUBLICATIONS

International Search Report dated Feb. 26, 2014 from corresponding PCT/US2013/062304, pp. 3.
International Written Opinion dated Feb. 26, 2014 from corresponding PCT/US2013/062304, pp. 7.

* cited by examiner

*Primary Examiner* — Justin Jonaitis
(74) *Attorney, Agent, or Firm* — McCarter & English, LLP; Deborah M. Vernon

(57) ABSTRACT

There is disclosed a piezoelectric droplet maker that is driven at high frequency and energized with high power and high frequency Operational Amplifier (OP-AMP) electronics. The droplet maker implements a method of producing jets of uniform droplets of solution precursors (or any other homogeneous liquids). The formation of droplets results from stream break up due to the disturbance of liquid jets by the piezo actuator as they leave an orifice. This disturbance can be electronically tuned to produce uniform droplets with high repeatability. In another aspect, the droplet maker can be used to inject axially uniform diameter solution precursor droplets into process gas flow of a microwave plasma apparatus.

17 Claims, 4 Drawing Sheets

HIGH FREQUENCY UNIFORM DROPLET MAKER AND METHOD

FIELD OF THE DISCLOSURE

The present disclosure relates to systems and methods for producing uniform droplets. More particularly, the present disclosure relates to systems and methods for producing uniform droplets using a piezoelectric actuator.

BACKGROUND OF THE DISCLOSURE

The demand for improved coatings and powder particle products in the thermal spray industry has been relentless as the technology suffers from compositional non-homogeneity of injected solution particles. One solution to achieve homogeneity in coatings and particle products is aimed at repeatedly producing uniform droplets with uniform diameter. Precise control of the size of the solution droplets injected into a thermal spray system achieves more precise control of the particle melt for successful and improved coatings and powder generation. The methods of droplet generation using capillary streams involve the use of a piezoelectric device impinging a pressure pulse on the walls of a reservoir vessel full of a liquid solution. In general, one such method is the imposition of amplitude modulated sinusoidal carrier disturbance on the piezoelectric device. These methods generally involve piezoelectric devices ("piezo") in direct contact with the liquid source. One method involves using an oscillating crystal in direct contact with a liquid source to impart a disturbance and initiate capillary instability responsible for stream break up into droplets. The disturbance is imposed in a compressive fashion at the top of the liquid volume and propagated downstream to the capillary nozzle. Another method imparts this disturbance on the side wall of a columnar liquid contained in a radially contracting piezoelectric cylinder that forces liquid through a capillary nozzle and is said to produce uniform stream of droplets. These droplet generation methods are, in general, limited to high droplet diameter and/or work at frequencies no higher than 10 KHz.

Applications of droplet apparatuses known in the art have the piezo in direct contact with the liquid. For example, in a typical printer design, the piezo is immersed in the printing liquid and serves as a gate to allow or forbid droplet exit as the piezo stretches or contracts under electrical drive. In another application, the piezo oscillations are transmitted directly to the liquid so that the piezo is in contact with the liquid or, if not in contact, the transmission is done through an elastic membrane. Furthermore, the effect of oscillations involves only a small volume of liquid directly near the nozzle.

SUMMARY OF THE DISCLOSURE

In one broad embodiment of the present disclosure, the systems for producing droplet streams with the droplets having uniform diameter, comprise: a solution dispenser in fluid communication with a fluid reservoir contained in a fluid reservoir vessel, a separation membrane disposed in the fluid reservoir vessel, the fluid reservoir adjacent to and in contact with one side of the separation membrane, a piezoelectric actuator in contact with the separation membrane on a side opposite that in contact with the fluid reservoir and disposed away from the separation membrane, and one or more capillary nozzles for receiving fluid from the fluid reservoir and ejecting a droplet stream from the one or more capillary nozzles.

In another broad embodiment, the systems for producing droplet streams with the droplets having uniform diameter, comprise: an electronics driver circuit for driving a piezoelectric actuator which acts as a capacitor, an operational amplifier (OP-AMP), a transformer stage, and a loading stage having a choke inductor. The choke inductor is in series configuration with a piezoelectric capacitor. This is intended to reduce the current requirements of the actuator operated alone by adding the inductor which in the ideal case make a resonant LC circuit with the actuator (capacitor) at the desired drive frequency. It has been found that, absent this inductor, the current requirements of the drive electronics become increasingly difficult to meet as the frequency is increased. The electronics driver circuit comprises a signal generator.

In another broad embodiment, the methods of the present disclosure for producing droplet streams with the droplets having uniform diameter, comprise: providing a solution to a fluid reservoir vessel, filling the fluid reservoir vessel with the solution to form a fluid reservoir, contacting the fluid reservoir disposed in the fluid reservoir vessel with one side of a separation membrane, contacting a piezoelectric actuator with the other side of the separation membrane, causing the piezoelectric actuator to send at least one perturbation pulse to the separation membrane and the fluid reservoir to create at least one perturbation wave through the fluid reservoir, receiving fluid from the fluid reservoir by one or more capillary nozzles disposed away from the separation membrane, and ejecting one or more droplet streams from the one or more capillary nozzles.

In another broad embodiment, the methods of the present disclosure for producing droplet streams with the droplets having uniform diameter, further comprise: actuating the piezoelectric actuator capacitor with a sinusoidal wave to produce perturbations on the separation membrane, and transmitting the perturbations through the separation membrane to the solution in the fluid reservoir.

BRIEF DESCRIPTION OF THE DRAWINGS

A specific embodiment of the present disclosure will now be more fully described in conjunction with the drawings which follow, in which.

DETAILED DESCRIPTION OF THE DISCLOSURE

Figure 1:
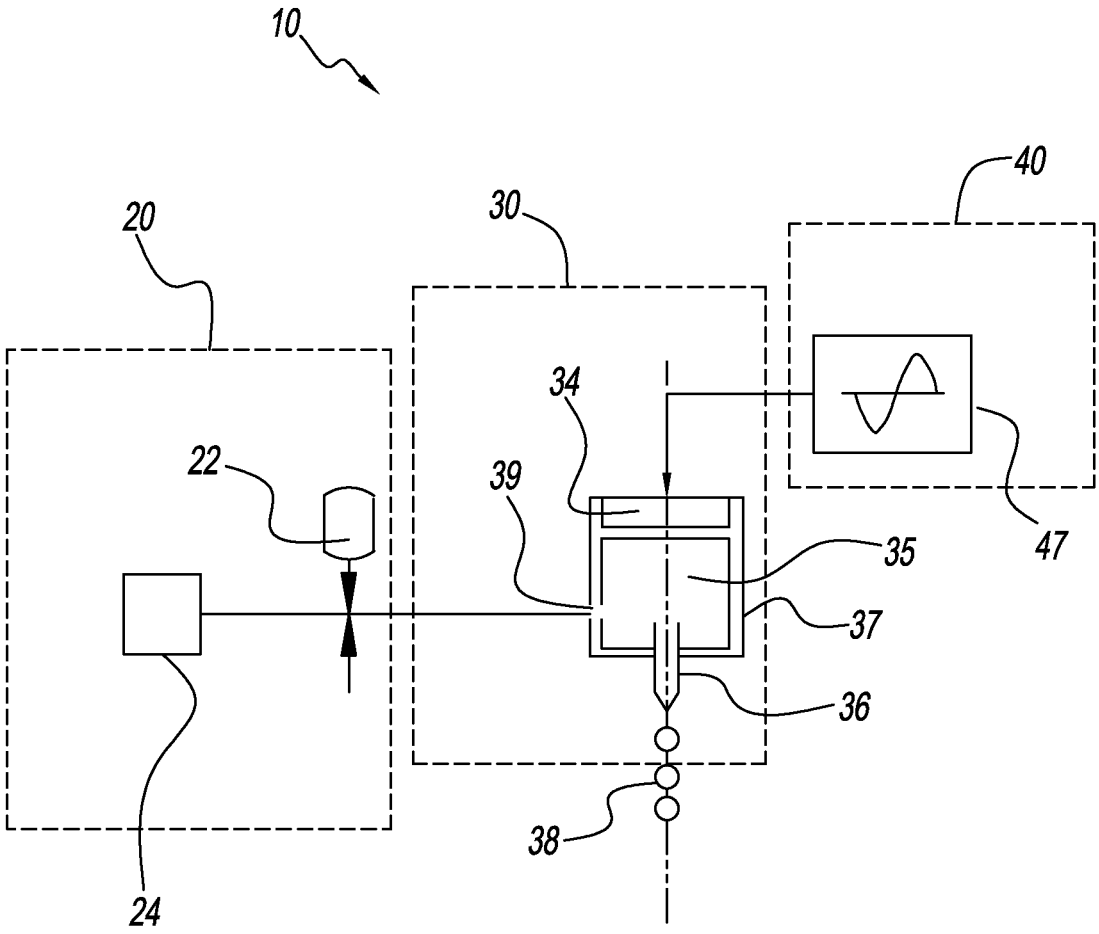
FIG. 1 shows a schematic view of a system for making uniform droplets according to the present disclosure.

Referring to the drawings and, in particular, to FIG. 1, there is provided one or more systems and/or methods for making uniform droplets generally represented by reference numeral 10. System 10 includes a solution dispenser 20, droplet maker portion 30, and high frequency electronics driver circuit 40. Droplet maker portion 30 includes internal piezo actuator 34, solution precursor reservoir 35 contained in reservoir vessel 37, and dielectric capillary nozzle(s) 36 for fluid jet exit. Transducer 34 is driven by high frequency OP AMP electronics circuit 47 that is preferably positioned in frequency elec tronics driver circuit 40. A stream of uniform droplets 38 are produced according to the Rayleigh breakdown law when transducer 34 is activated by drive electronics 47, while solution precursor reservoir 35 is maintained full by solution precursor injection through inlet fitting 39 via peristaltic pump 22 (or pressurized tank vessel) from solution precursor container source 24.

Figure 2:
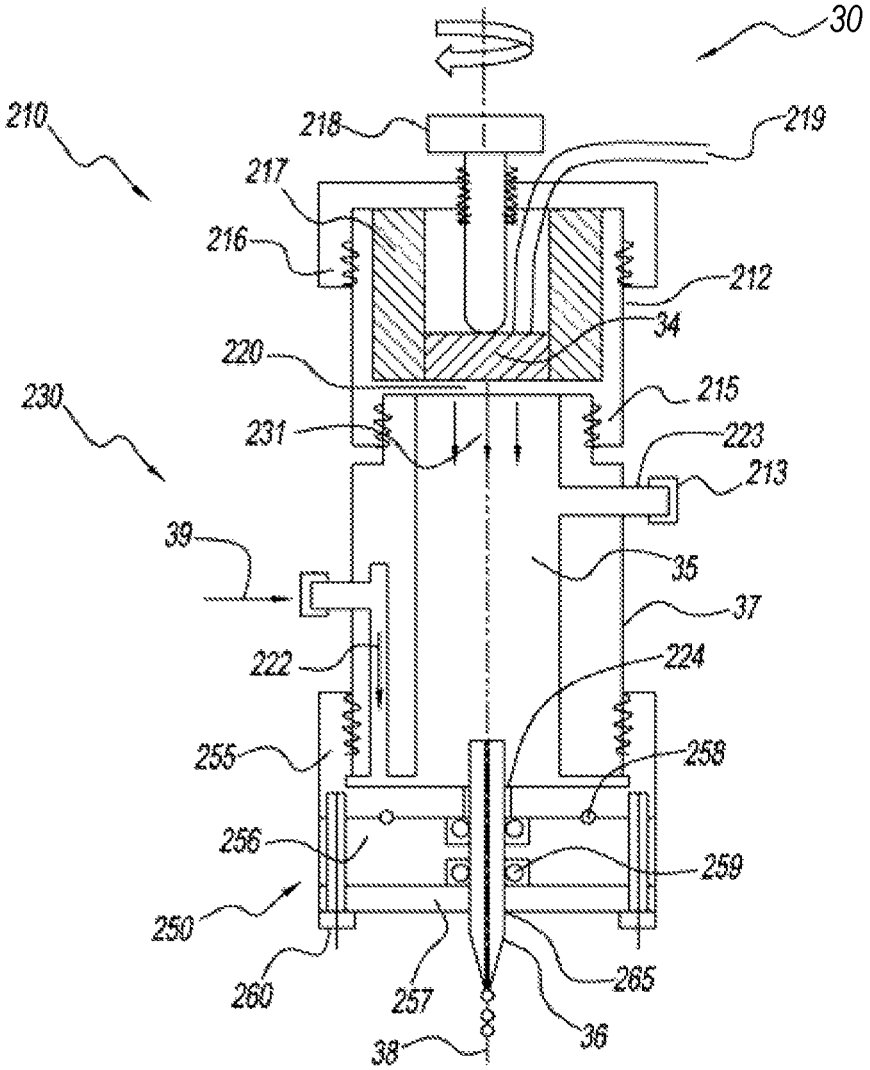
FIG. 2 shows a schematic view of a preferred embodiment of a droplet making apparatus according to the present disclosure.

Referring to FIG. 2, droplet maker portion 30 according to a preferred embodiment of the present disclosure is shown in more detail. Droplet maker portion 30 comprises three stages, including piezo housing stage 210, reservoir vessel stage 230, and nozzle holder stage 250. Piezo housing 210 has a retaining device 212 that includes steel pipe 215 and screw cap 216. Piezo actuator 34 is held axi-symmetrically by thermal insulator 217. Swivel bolt 218 which screws into screw cap 216 is used to apply pressure to piezo actuator 34. Under sinusoidal electrical excitation through connecting wires 219, piezo actuator 34 produces oscillations of about 5 μm or less which are, in turn, communicated to separation membrane 220 between piezo housing 210 and reservoir vessel 37. The oscillations by piezo actuator 34 produce perturbation pressure pulses 231 which, in turn, are communicated to the liquid in solution precursor reservoir 35. Membrane 220 should have a thickness that allows for sufficient deflection to create pressure pulses on solution precursor reservoir 35 and a sufficient stillness to allow for adequate preloading of the piezoelectric actuator 34. It has been found that a thickness of about 21 gauges (0.723 mm) is used in the preferred embodiment of the present disclosure. Reservoir vessel 37 is filled with precursor solution through filling channel 222 and inlet fitting 39 connected to solution dispenser 20 (see, FIG. 1), Channel 222 allows for total evacuation of solution precursor reservoir 35 so as to avoid clogging of capillary nozzle(s) 36 due to drying of left over precursor solution. Bleeding outlet 223 is provided through fitting 213 in order to evacuate air bubbles from solution precursor reservoir 35, if necessary, and to maintain adequate pressure on solution precursor reservoir 35. Orifice 224 is at the bottom of the vessel holding solution precursor reservoir 35 to allow communication of solution precursor reservoir 35 from reservoir vessel 37 to capillary nozzle(s) 36 in nozzle holder 250 to outside of droplet maker portion 30 of FIG. 1. Nozzle holder 250 includes screw cap 255, disk positioning portion 256, cover plate 257, sealing O-ring 258 and sealing and positioning O-rings 259. Disk positioning portion 256 and cover plate 257 are held in place in screw cap 255 with screws 260. The thickness of disk positioning portion 256 should preferably be chosen to have a thickness less than the length of capillary nozzles 36 (FIG. 1) so as to provide, in conjunction with O-rings 259, adequate alignment of capillary nozzles 36, the tip of which emerges though orifice 265 of cover plate 257. Once solution precursor reservoir 35 is full of precursor fluid, and piezo actuator 34 is activated through drive pulse wires 219, perturbation pressure pulses 231 are transmitted through membrane 220 to the top of solution precursor reservoir 35 in reservoir vessel 37. Perturbation pressure pulses 231 propagate down the columnar volume of the solution precursor reservoir 35 in reservoir vessel 37. Perturbation pressure pulses 231 reach the bottom of the reservoir vessel 37, transmitting fluid from solution precursor reservoir 35 from reservoir vessel 37, where the fluid jet breaks up into a stream of droplets 38. Droplets 38 are of uniform diameter if the wavelength of the perturbation pressure pulses 231, satisfy jet stream break up according to Webber's law for viscous fluids:

$$\lambda = \sqrt{2}\,\pi d_j \sqrt{1 + 3\eta / \sqrt{\rho\sigma d_j}}$$

where $d_j$ is the jet diameter, $\eta$ is the fluid viscosity, $\rho$ is the fluid density, and $\sigma$ the surface tension. The droplets produced are uniform and their diameter, $d_d$, is 1.89 that of the jet diameter, $d_j$.

Figure 3:
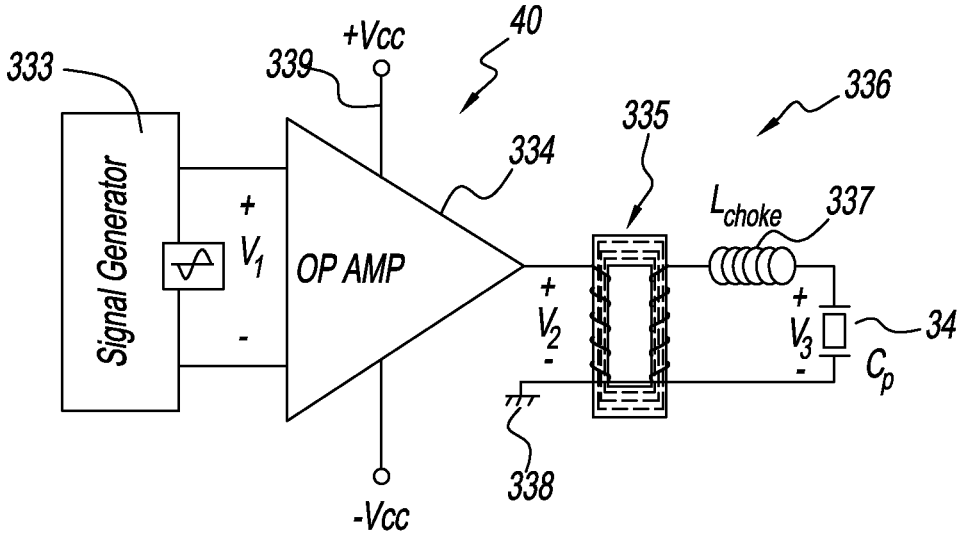
FIG. 3 shows a schematic view of electronics for driving a piezoelectric transducer according to the present disclosure.

Referring to FIG. 3, high frequency electronics driving circuit 40 of FIG. 1 for driving piezo capacitor $C_p$, of piezo actuator 34 comprises signal generator 333, operational amplifier (OP-AMP) 334, transformer stage 335, and loading stage 336 having choke inductor 337 in series with piezo capacitor $C_p$, of piezo actuator 34. This configuration operates in a continuous mode to generate piezo voltage drive ($V_3$), due to source voltage ($V_1$), amplified to voltage ($V_2$) by OP-AMP 334, to drive piezo actuator 34. Signal generator 333 delivers sinusoidal wave with frequencies from 0 to 1 MHz or higher and output voltage between 0 and 10 volts. The high current drive capability and wide power bandwidth OP-AMP 334 (with controllable gain) drives the primary of transformer 335 and produces an amplitude modulated voltage ($V_2$) of up to about 70 volts and frequencies up to 200 KHz for prescribed frequency drive at signal generator 333. Transformer 335 allows stepping up the output voltage ($V_2$) to required higher voltage for loading stage 336. In the embodiment shown in FIG. 3, the step up factor used was 1:1 and voltage V2 is equal to V3 as no stepping up is used. However, stepping up to any desired voltage can be achieved if more power is required by the load output. Transformer 335 configurations allow complete isolation from ground 338 of driver circuit comprising OP-AMP 334 and signal generator 333. In loading stage 336, choke inductor 337 is chosen in conjunction with $C_p$, the capacitance of the actuator, to provide a frequency bandwidth as high 100 KHz and high enough currents (on the order of dozens of milliamperes (mA)) from 50 to 200 mA to drive the capacitive load $C_p$, of piezo actuator 34. This design operates at frequencies lower than about 100 KHz with drive output voltage up to 60 Volts and low enough that $+V_{cc}$ and $-V_{cc}$ DC voltage sources 339 avoid voltage saturation at piezo drive voltage ($V_3$).

Figure 4A:
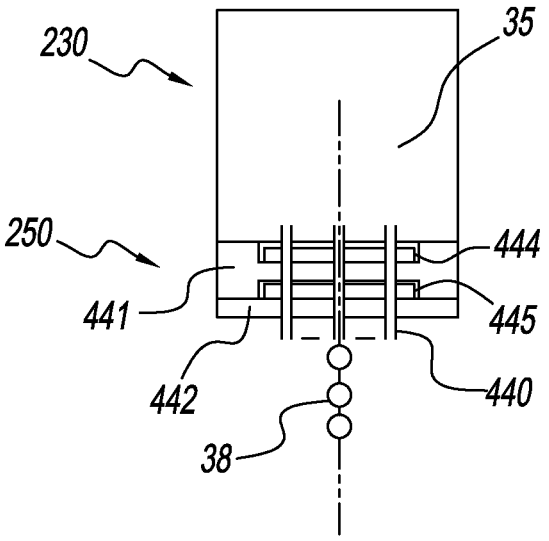
FIGS. 4*a* and 4*b* show a schematic view of a multi-capillary nozzle for making multiple jets of uniform droplets according to the present disclosure.
Figure 4B:
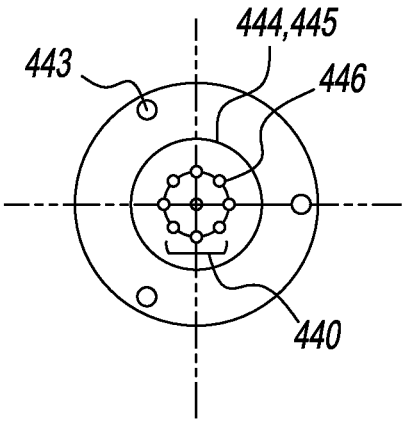

Referring to FIGS. 4*a* and 4*b*, multiple capillary nozzle assembly 440 is held in place by nozzle holder 250 and in contact with solution precursor reservoir 35 source in reservoir vessel 37. Disk positioning portion 441 and cover plate 442 are fastened to nozzle holder 250 with screws 443. Two sealing and positioning O-rings, 444 and 445, are inserted inside nozzle holder 250 to align rectilinearly all capillaries 446 in the capillary nozzle assembly 440. Capillaries 446 are configured as compactly as possible but, however, with sufficient space separation, e.g., no less than about 3 mm, to allow for distinct and non-communicating streams of uniform droplets 38. The system of FIGS. 4*a* and 4*b* uses the same electronics driving circuit 40 and solution dispenser 20 used for the embodiment in FIG. 1.

According to the present disclosure, the concept of the membrane separating the actuator and the disturbed liquid is unique since the membrane is made of stainless steel or other rigid material and is very rigid with a prescribed thickness. The selection of the membrane thickness is based on the stiffness with the membrane being sufficiently flexible to transmit a suitable amount of deflection from the actuator into the fluid. This leads to a wide range of possible choices of membrane thicknesses and in-plane dimensions. In general for such a concentrated load from an actuator acting, for example, on a circular membrane (which behaves as a circular plate) the stiffness of a circular membrane is proportional to $E h^3/R^2$ where R is the membrane radius, E is the Young's modulus of the membrane material and h is the membrane thickness. Similar relations apply to other membrane shapes such squares and rectangles, etc. Thus, a broad range of designs are possible depending on the force capabilities of the actuator and the properties of the fluid to be expelled. The geometry may include all geometries with a suitable stiffness range which, in turn, is dependent on the actuator chosen and the chamber design and the fluid properties. The design thus can be calculated for any particular application by one of ordinary skill in the art. For the actuator used in the example and Figures, R=0.35", h=0.02846" and E=26×106 psi (approximately) and has been found to be usable for a range of fluids used in the exemplified actuator/chamber combination. Thus, using the above equation and the actuator and chamber exemplified, the present example employed a stainless steel membrane having a thickness of 21 gauges (0.723 mm). The membrane acts as a protective barrier for the piezo actuator from hostile liquids, and transmits the perturbation pressure pulse(s) of the piezo actuator to the liquid on the other side of the membrane.

In the specific embodiment described in connection with the Figures, the droplet maker can utilize hostile liquids such as acids (and bases) because the housing, including the reservoir, has an integrated "functional" rigid and chemical-resisting membrane made of corrosion resistant material, such as stainless steel, titanium, or a rigid material that is coated with a chemical-resistant material such as Teflon. Furthermore, the capillary nozzle is made of a dielectric that is chemically stable and can handle similar hostile liquids. Such configuration and construction of the reservoir separates the piezo actuator from the liquid. The separation membrane serves as a protective barrier for the piezo actuator. The piezo actuator is not in direct contact with the liquid. Instead, the vibrations of the piezo actuator are transmitted as perturbation pressure pulses through the rigid membrane to the liquid. Stainless steel housing has been tested with precursors containing citric acid resulting in solution with a pH of about 4. For an even more hostile environment with more acidic or basic pH, hastalloy, or other material resistant to the pH, can be used.

It is believed that the use of ceramic capillaries is unique for longitudinal actuation of the perturbation pressure pulse(s). Known systems and methods use glass capillaries, similar in shape to those capillaries of the present disclosure, but have been used for radial actuation instead which differs from the longitudinal actuation of the present disclosure.

In a multi-capillary nozzle configuration of the present disclosure, a configuration that may include 2, 3, 4, 5 or more capillaries, a symmetrical topology may preferably be used to position the capillaries to distribute evenly the liquid perturbation pressure pulse(s) for uniform droplet breakdown across all capillaries. As the piezo actuator is a disk of, e.g., 10 mm and doughnut shaped, the perturbation pressure pulse(s) is/are cylindrical in shape with a circular cross section. The capillaries are placed on a generally circular configuration smaller than the diameter of the doughnut-shaped piezo actuator.

While use of capillaries with a small diameter may generally be prone to clogging, according to the present disclosure a purging scheme has been devised to minimize or avoid clogging due to hardening of acid and/or metallic salt-based solution(s). In the present disclosure, the inlet to the liquid reservoir is run through a tunnel (channel 222 in FIG. 2) machined inside the wall of the reservoir, which runs parallel to the main axis of the reservoir, and emerges at the bottom of the reservoir. During purging or evacuation of the precursor (which can harden if left even in a minute volume at the bottom of the reservoir) because the evacuation tunnel reaches all the way to the bottom of the reservoir, the entire amount of precursor is purged. This saves valuable precursor and avoids clogging through hardening as well. Such a procedure may be followed with purging with distilled water to cleanse the inside of the reservoir and the capillary nozzle. Furthermore, in a preferred embodiment, that portion of the capillary more closely in contact with the fluid in the fluid reservoir vessel protrudes slightly with respect to the bottom of the reservoir so that any incidental clogging debris can accumulate at the bottom of the reservoir below the capillary entrance.

The OP-AMP with the transformer circuit configuration driving the LC loading stage is designed as "resonant" for optimum drive of the LC circuit. The droplet making frequency regime is chosen to be below the natural resonant frequency of the piezo capacitor to increase its lifetime. Also, the present configuration uses a small piezo ring (doughnut) shaped disk with a small capacitance (on the order of 15 nanoFaraday (nF)) which pushes the frequency bandwidth of the drive circuit to higher frequencies.

Preferably, the fluid reservoir vessel is generally or substantially cylindrical in shape, having a bottom surface and a top surface which are generally or substantially circular in shape and a columnar side portion disposed between the bottom surface and the top surface. Preferably, the solution dispenser is in communication with the fluid reservoir vessel via a fluid transfer line between the solution dispenser and the fluid reservoir vessel, with the transfer of fluid from the solution dispenser to the fluid reservoir vessel effected with a pump, preferably a peristaltic pump or pressurized tank vessel. Also preferably, the fluid is transferred from the solution dispenser to the fluid reservoir vessel via a channel that causes the fluid to enter the fluid reservoir vessel at or near the bottom surface of the fluid reservoir vessel. Also preferably, the fluid reservoir vessel has an outlet disposed generally at or near the top surface of the fluid reservoir vessel.

Preferably, as mentioned above, the reservoir vessel is made of a relatively corrosion resistant material, such as stainless steel, or steel coated with stainless steel, vanadium, titanium, and the like, but may also be made of plastic coated material, and the coating may be of, e.g., Teflon or another corrosion resistant material. The separation membrane may be part of the fluid reservoir vessel or may be part of the piezo actuator structure. In any event, the separation membrane should have characteristics which provide suitable mechanical properties to the separation membrane. The separation membrane should be of sufficient thickness or made of suitable material to allow for deflection of the separation membrane by the piezo actuator, thus imposing perturbation pressure pulse(s) on the fluid reservoir. Thus, the stiffer the separation membrane, it is likely the thinner the separation membrane will need to be. In addition, the separation membrane should have sufficient but adequately low stiffness so as to allow for adequately proper preloading of the piezo actuator. Therefore, the characteristics of the separation membrane are, in general, related but to some degree of opposite nature. The membrane where the deflections occur provides perturbation pressure pulse(s) to the liquid in the reservoir vessel and allows deflection transmission without direct physical contact between the piezo actuator and the liquid.

Capillary nozzles are generally known in the art. The capillary nozzle is generally cylindrical in shape with an inner bore diameter of from less than about 10 micrometers up to about 100 micrometers. Preferably, the inner bore diameter is between about 5 micrometers to about 100 micrometers. More preferably, the inner bore diameter is between about 1-2 micrometers to about 100 micrometers. The length of the capillary nozzle is preferably no less than 5 mm and can be up to about 30 mm or longer. In an alternative embodiment, the nozzle holder is configured to hold a plurality of similarly-sized and shaped capillary nozzles in order to produce multiple stream jets of uniform droplets. The capillary nozzle(s) may be made of stainless steel, ceramic material and the like, but may also be made of any other sufficiently rigid and chemically resistant material, so as to withstand any corrosive nature of the fluid.

The size and configuration of the nozzle(s) allows for droplet streams having uniform diameters smaller than about 200 micrometers, preferably smaller than about 150 micrometers, more preferably smaller than 100 micrometers, and most preferably smaller than about 50 micrometers. For smaller droplets with diameter size below about 100 micrometers, it has been found that higher frequency and power drives are generally useful. The present disclosure aims at producing droplets with diameters as low as 5 micrometers for which higher frequency (higher than 10 KHz) may be used. This present disclosure can achieve even smaller diameters, as low as 1 micrometer, if capillaries with similar diameter are used. Also, contrary to the known methods and apparatuses, according to the present disclosure, the membrane on which the piezoelectric actuator impacts can be far away from the liquid input entry to the capillary nozzle, or nozzles. Specifically, distances up to 4 inches or more are possible. On the other hand, configurations with an actuator close to the exit orifice may also be used. Depending upon the application, performance may be enhanced for a specific frequency if the chamber length is chosen such that a standing wave is produced with its maximum pressure located near the exit orifice.

In a particularly preferred embodiment, the system of the present disclosure for producing droplet streams with, the droplets having uniform diameter. The system comprises: a reservoir vessel as a containment for solution precursors, a dismountable housing with strain relief for a piezoelectric device to generate displacement following a pressure pulse on the fluid volume of reservoir vessel, a high frequency and high power electronics drive that generates a continuous oscillating voltage pulse, one or more capillary nozzle(s) to discharge one or more jet(s) of uniform droplets after perturbation of volume of liquid in reservoir vessel, and a nozzle holder for a single or multiple capillary nozzles. The piezoelectric device is electronically energized to expand and contract under a sinusoidal voltage drive. In another particularly preferred embodiment, the reservoir vessel is a cylindrical chamber with at least one inlet input and one purge output. In still another particularly preferred embodiment, the housing chamber of the piezoelectric device includes: a sealed chamber including a cylinder with a screw on cap, a screw on bolt, and a cylindrical sleeve. Also preferably, the piezoelectric device is axis—symmetrically positioned with the cylindrical sleeve and held in place against the bottom of the cylinder by the screw on bolt for mounting and preloading, Still preferably, the voltage drive can deliver square, triangular, and sinusoidal signal pulses of 0 to 50 volts in amplitude at frequencies up to 100 KHz.

In additional particularly preferred embodiments, the systems of the present disclosure for producing droplet streams with the droplets having uniform diameter, the piezoelectric device or other device is capable of delivering perturbation pressure pulses which give rise to displacements of the separation membrane of few micrometers or more. For example, the displacement of the membrane may be 1-5 micrometers, preferably less than 5 micrometers, more preferably less than 3 micrometers, and more preferably from less than 1 to about less than 3 micrometers. The displacement range to be produced is to include displacements of a size sufficient to induce droplet break up which may vary based on the properties of the fluid being expelled. Also in this embodiment the high frequency and high power electronics includes a signal generator, a high voltage and high current OP AMP stage, a transformer, and a loading stage with a choke inductor in series with piezoelectric capacitive load device operating at a lower frequency than the resonant frequency of the choke-piezo capacitor load. Efficient driving of the piezo actuator without the use of very large current supplies is achieved by LC resonance tuning or near tuning of the LC circuit made with the actuator capacitance and the selected inductor. Also especially preferable, the capillary nozzles are held in a nozzle holder that is made of stainless steel and comprises a steel cap to seal the reservoir vessel and hold and align the capillary nozzles. Also preferably, the signal generator has a frequency of between 0 and 1 MHz or higher, and produces an output voltage of between 0 and 10 volts or higher. The amplifier and transformer together convert the output voltage to a voltage of at least about 20 volts, preferably at least 30 volts, more preferably of from about 30 to about 50 volts, especially preferably from about 40 volts to about 50 volts, and most preferably from about 50 to about 60 volts. Also, the amplifier and transformer together convert frequencies at or above 10 KHz, preferably at or above 20 KHz, more preferably at or above about 30 to about 40 KHz, most preferably at or above about 50 KHz, up to about 70 MHz or higher, such as up to about 100 KHz to about 200 KHz.

Because the piezoelectric device of the presently disclosed methods and systems is not in direct contact with the liquid source, this allows for flexible and simple piezoelectric mounting. The piezoelectric device can be mounted anywhere convenient in association with the solution precursors of the droplet stream, and allows for use of solution precursors for the droplet stream that can be corrosive. As stated above, preferably the perturbation pressure pulses are produced in a sinusoidal fashion and, more preferably, the sinusoidal wave is produced by a signal generator that transmits a source voltage to an amplifier to amplify and modulate the source voltage to produce an amplified and modulated voltage, which amplified and modulated voltage is then transmitted to a transformer which steps up the voltage to produce a stepped up voltage. The stepped up voltage is then transmitted to a piezo capacitor which, in turn, transmits a pressure pulse to separation membrane. Further, the pressure pulse is transferred through separation membrane to the solution in the fluid reservoir. Still further, the pressure pulse is repeatedly transferred to the solution through the separation membrane and propagates through the solution and forces the solution into the capillary, thereby ejecting the solution through the capillary and producing a stream of uniform droplets.

While the present disclosure has been described with reference to particular embodiments, it will be understood by those skilled in the art that various changes may be made and equivalents may be substituted for the elements thereof without departing from the scope of the disclosure. In addition, many modifications may be made to adapt the teaching of the present disclosure to particular use, application, manufacturing conditions, use conditions, composition, medium, size, and/or materials without departing from the essential scope thereof. Therefore, it is intended that the present disclosure not be limited to the particular embodiments and best modes contemplated for carrying out this disclosure as described herein. The accompanying claims are intended to cover such modifications as would fall within the true scope and spirit of the present disclosure.

What is claimed is:

1. A system for producing droplet streams having droplets with uniform diameter, the system comprising:

a solution dispenser in fluid communication with a fluid reservoir in a fluid reservoir vessel and disposed to maintain the fluid reservoir filled with fluid and under pressure via a channel running substantially parallel to a main axis of the fluid reservoir in the direction of one or more capillary nozzles;

a separation membrane defining a first end of the fluid reservoir and in contact with the fluid on one side of the separation membrane;

a piezo actuator in contact with the separation membrane on a side opposite that in contact with the fluid; and the one or more capillary nozzles disposed at a second end of the fluid reservoir away from the separation membrane, the fluid within the fluid reservoir contacting both the separation membrane and the one or more capillary nozzles, wherein the one or more capillary nozzles receive fluid from the fluid reservoir and eject a droplet stream from the capillary nozzle.

2. The system for producing droplet streams according to claim 1, wherein the fluid reservoir vessel is generally or substantially cylindrical in shape.

3. The system for producing droplet streams according to claim 1, wherein the solution dispenser is in communication with the fluid reservoir vessel via a fluid transfer line between the solution dispenser and the fluid reservoir vessel.

4. The system for producing droplet streams according to claim 1, wherein one or more perturbations are provided to the fluid reservoir by action of the piezo actuator on the separation membrane and the one or more perturbations are evenly distributed to the one or more nozzles.

5. The system for producing droplet streams according to claim 4, wherein the capillary nozzle is made of stainless steel or dielectric material.

6. The system for producing droplet streams according to claim 3, wherein the solution dispenser transfers fluid therefrom to the fluid reservoir vessel by a peristaltic pump or pressurized tank.

7. The system for producing droplet streams according to claim 3, wherein the fluid reservoir vessel has an outlet disposed generally at or near an upstream surface of the fluid reservoir vessel.

8. The system for producing droplet streams according to claim 1, further comprising:

an electronics driver circuit for driving a piezo capacitor, the electronics driver circuit comprised of a signal generator, an operational amplifier, a transformer stage, a loading stage having a choke inductor, and a piezo capacitor, and wherein the choke inductor is in series with the piezo capacitor.

9. The system for producing droplet streams according to claim 8, wherein the signal generator delivers sinusoidal, triangular, or square waves with frequencies from 0 to 1 MHz or higher, and an output voltage between 0 to 10 volt to the operational amplifier.

10. A method for producing droplet streams having the droplets with a uniform diameter, the method comprising:

providing a solution to a fluid reservoir vessel;

filling a fluid reservoir within the fluid reservoir vessel with the solution via a channel running substantially parallel to a main axis of the fluid reservoir in the direction of a capillary nozzle, such that the solution contacts a separation membrane and the capillary nozzle;

contacting a piezo actuator with the separation membrane on a side opposite that in contact with the solution;

causing the piezo actuator to send at least one perturbation pulse to the separation membrane and the fluid reservoir to create at least one perturbation wave through the fluid reservoir;

receiving fluid from the fluid reservoir by the capillary nozzle disposed away from the separation membrane; and ejecting a droplet stream from the capillary nozzle.

11. A system for producing droplets, the system comprising:

a fluid reservoir vessel defining a fluid reservoir, the fluid reservoir vessel including a rigid separation membrane having a thickness of about 0.723 mm disposed at a first end;

one or more capillary nozzles disposed at a second end of the fluid reservoir vessel opposite the separation membrane;

a solution dispenser in fluid communication with the fluid reservoir and disposed to maintain the fluid reservoir filled with fluid such that the fluid contacts the separation membrane and the one or more capillary nozzles, the solution dispenser further disposed to maintain the fluid reservoir under pressure to create a fluid stream exiting the one or more capillary nozzles; and a piezo actuator in contact with the separation membrane on a side opposite that in contact with the fluid, the piezo actuator disposed to transfer a pressure wave through the fluid in the fluid reservoir to break up the fluid stream into droplets.

12. The system of claim 11, wherein the solution dispenser is disposed to maintain the fluid reservoir filled with fluid and under pressure using a peristaltic pump or pressurized tank.

13. The system of claim 11, further comprising:

an electronics driver circuit for driving a piezo capacitor, the electronics driver circuit comprising a signal generator, an operational amplifier, a transformer stage, a loading stage having a choke inductor, and wherein the choke inductor is in series with the piezo capacitor.

14. The system of claim 13, wherein the signal generator is disposed to deliver sinusoidal, triangular, or square waves with frequencies from 0 to 1 MHz or higher, and an output voltage between 0 to 10 volts to the operational amplifier.

15. The system of claim 11, wherein the fluid reservoir is substantially cylindrical in shape.

16. The system of claim 11, wherein the one or more capillary nozzles are made of stainless steel or a dielectric material.

17. A method for producing droplets, the method comprising:

providing a solution to a fluid reservoir vessel;

filling the fluid reservoir vessel with the solution such that the solution contacts a rigid separation membrane having a thickness of about 0.723 mm and creates a fluid stream exiting a capillary nozzle;

activating a piezo actuator to create a pressure wave traveling through the filled reservoir toward the capillary nozzle, the piezo actuator in contact with the separation membrane on a side opposite that in contact with the solution; and breaking up the fluid stream into droplets using the pressure wave traveling through the filled reservoir.

* * * * *